US005621278A

United States Patent [19]

Chambers

[11] Patent Number: 5,621,278

[45] Date of Patent: Apr. 15, 1997

[54] IGNITION APPARATUS

[75] Inventor: Martin J. Chambers, Shenstone, England

[73] Assignee: Lucas Industries Public Limited Company, England

[21] Appl. No.: 258,859

[22] Filed: Jun. 13, 1994

[30] Foreign Application Priority Data

Jun. 11, 1993 [GB] United Kingdom ..... 9312108

[51] Int. Cl.[6] ..... F02P 3/06; F02P 3/08

[52] U.S. Cl. ..... 315/209 CD; 315/209 SC; 315/205; 315/219; 315/209 J; 123/620; 123/604; 361/257; 361/263

[58] Field of Search ..... 315/209 T, 209 CD, 315/209 SC, 209 M, 219, 205, 209 R; 123/620, 604; 361/253, 257, 256, 263; 60/39.821, 39.827

[56] References Cited

U.S. PATENT DOCUMENTS

| | | | |
|---|---|---|---|
| 3,505,563 | 4/1970 | Randall et al. | 315/213 |
| 4,292,569 | 9/1981 | Gerry | 315/209 R |
| 5,084,800 | 1/1992 | Hijikata | 361/257 |

FOREIGN PATENT DOCUMENTS 2611327 8/1988 France .

*Primary Examiner*—Robert Pascal
*Assistant Examiner*—Arnold Kinkead
*Attorney, Agent, or Firm*—Andrus, Sceales, Starke & Sawall

[57] ABSTRACT

A charging circuit charges a first capacitor to a first voltage and a second capacitor, via a potential divider to a second voltage smaller than the first voltage. A trigger circuit repeatedly triggers a thyristor which discharges the second capacitor into the primary winding of a pulse transformer whose secondary winding is connected across a diode in series with the first capacitor between output terminals.

8 Claims, 2 Drawing Sheets

IGNITION APPARATUS

BACKGROUND OF THE INVENTION

The present invention relates to an ignition apparatus is suitable for use with a gas turbine engine.

Existing solid state ignition designs have difficulty in achieving high levels of output current (over 1,500 amps) at high temperatures (over 125° C.) due to both static (leakage current) and dynamic (switching) losses in the solid state switch.

U.S. Pat. No. 3,505,563 discloses an ignition apparatus having a storage capacitor which stores charge for creating and maintaining a discharge through an igniter plug. The capacitor is connected via a spark gap to the igniter plug. The spark gap has a voltage rating such that the voltage across the capacitor when fully charged is insufficient to break down the spark gap.

The spark gap has a trigger terminal which is connected to a voltage pulse producing circuit. This circuit comprises a transformer whose secondary is connected to the trigger electrode of the spark gap. A capacitor is periodically discharged by a thyristor into the primary winding of the transformer. The output pulse produced by the secondary winding of the transformer is sufficient to initiate breakdown of the spark gap so as to control discharge of the capacitor through the igniter plug.

Such an arrangement requires the use of a spark gap having a separate trigger terminal. Thus, although the stress on the thyristor is reduced by employing a voltage step-up transformer, this arrangement is more complicated and expensive. Further, the capacitor is still required to be charged to a voltage sufficient to initiate discharge in the igniter plug.

SUMMARY OF THE INVENTION

According to a first aspect of the invention, there is provided an ignition apparatus comprising an energy store and discharge means for discharging the energy store, characterised in that the discharge means is arranged such that, in use, the potential difference across the discharge means is less than the potential difference across the energy store.

According to a second aspect of the invention, there is provided an ignition apparatus comprising a first energy store, a first charging circuit for charging the first energy store to a first potential difference, a second energy store, a second charging circuit for charging the second energy store to a second potential difference which is less than the first potential difference, a pulse transformer having primary and second windings, and discharge means for discharging the second energy store into a primary winding of the pulse transformer, characterised in that the secondary winding is connected in series with the first energy store between output terminals of the apparatus.

Preferably the discharge means is a solid state switch, such as a thyristor. Operating the thyristor at a substantially lower voltage than that required of the energy storage capacitor reduces the static losses in the thyristor. By separating the high voltage generation circuit from the main energy discharge circuit, the thyristor action can be limited to the generation of the high voltage pulse. Once the igniter plug has ionised, the thyristor plays no part in the main energy delivery. Thus dynamic losses are greatly reduced as the energy required to generate a high voltage pulse is substantially lower than that required in the main energy storage.

BRIEF DESCRIPTION OF THE DRAWING

The invention will be further described, by way of example, with reference to the accompanying drawings, in which.

DESCRIPTION OF THE PREFERRED EMBODIMENTS

Figure 1:
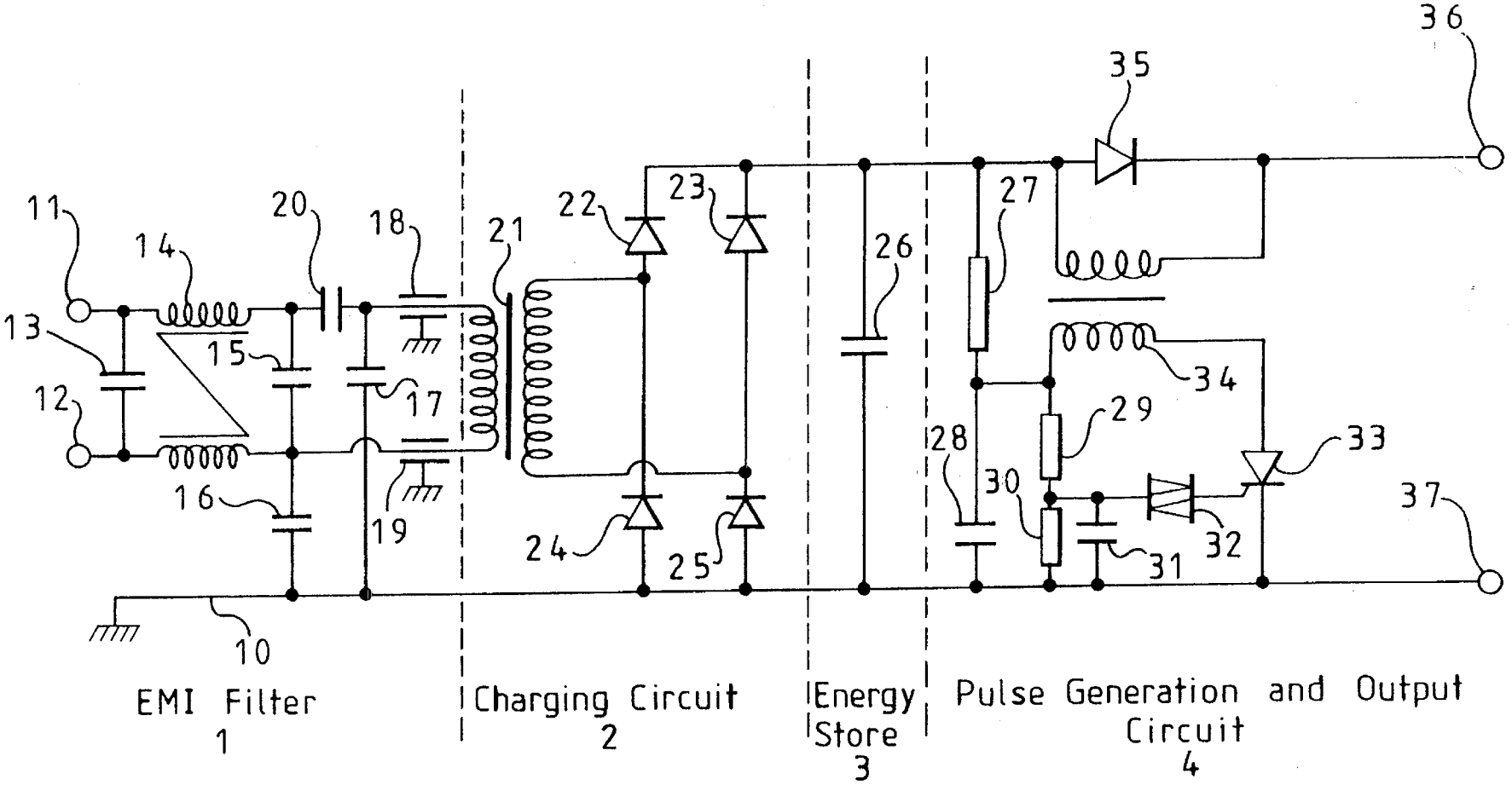
FIG. 1 is a circuit diagram of an ignition apparatus constituting a preferred embodiment of the invention.

In the drawings, like reference numerals refer to like parts.

The apparatus shown in FIG. 1 comprises an electromagnetic interference (EMI) filter 1, a charging circuit 2, an energy store 3, and a pulse generation and output circuit 4.

The EMI filter 1 comprises a filter capacitor 13 connected across power supply input terminals 11 and 12 for connection to a low voltage alternating power source, such as a 115 volts source at 400 Hz. A filter inductor arrangement 14 is connected in series with the power supply lines and blocks any voltage spikes which may be present in the supply to the apparatus. A further filter capacitor 15 is connected across the outputs of the inductor arrangement 14 and filter capacitors 16 and 17 are connected between the internal supply lines of the apparatus and a common or ground connection 10. Feed-through capacitors 18 and 19 provide further filtering and a capacitor 20 limits the maximum current in the event of a short circuit at the output of the apparatus.

The charging circuit 2 comprises a transformer 21 whose primary is connected to the receive the filtered power from the filter 1. The secondary winding of the transformer 21 is connected to a diode rectifier bridge comprising rectifier diodes 22 to 25. The output of the bridge is connected across the energy store 3 which comprises a capacitor 26.

The energy store 3 is connected to the pulse generation and output circuit 4. A capacitor 28 is charged via a resistor 27 to a voltage determined by a potential divider formed by the resistor 27 and resistors 29 and 30. the capacitor 28 is connected between the common line 10 and one end of the primary winding of a voltage step-up pulse transformer 34. The other end of the primary winding is connected via a thyristor 33 to the common line 10. the connection between the resistors 29 and 30 is connected via a capacitor 31 to the common line 10 and via a diac 32 or other breakover diode to the gate of the thyristor 33.

The secondary winding of the transformer 34 is connected in parallel with a diode 35 and the parallel circuit thus formed is connected in series with the capacitor 26 between output terminals 36 and 37 of the apparatus. The polarity of the diode 35 is such that, once an igniter plug connected to the output terminals 36 and 37 has begun to conduct, the discharge is maintained by current flowing from the capacitor 26. However, the diode 35 is reverse-biassed by the output pulses supplied by the transformer 34.

In order to ignite or reignite, for instance, a gas turbine engine, power is supplied to the input terminals 11 and 12 of the apparatus. The transformer 21 steps up the voltage and, via the rectifier diodes 22 to 25, charges the capacitor 26. The rate of charging of the capacitor 26 is determined by the leakage reactance of the transformer 25, which is wound so as to have a high leakage reactance. The apparatus is arranged such that the energy stored in the capacitor 26 is nine joules at 750 volts.

The apparatus is arranged such that the capacitor 28 is charged to a maximum voltage of 400 volts. Thus, the thyristor 33 is required to switch 400 volts, instead of the 750 volts across the capacitor 26, so that the static stress on the thyristor 33 is reduced. The potential divider comprising the resistors 29 and 30 charges the capacitor 31 to a lower value, such as 20 volts, required to trigger the diac 32 and hence trigger the thyristor 33. The values chosen for the various components are, for instance, such that the thyristor 33 is triggered 1.5 times per second which, in turn, determines the sparking rate.

Thus, as soon as the voltage across the capacitor 26 reaches 750 volts, the diac 32 breaks over and triggers the thyristor 33. The thyristor 33 discharges the capacitor 28 into the primary winding of the transformer 34. The transformer 34 has, for instance, a turns ratio of 50:1 so that the voltage induced across the secondary winding of the transformer can rise as high as 20 kilovolts. This voltage reverse-biases the diode 35, which must therefore be rated to withstand it.

This high voltage pulse is effectively applied (in series with the 750 volts across the capacitor 26) across the igniter plug. The igniter plug ionises and the voltage across it fails from its breakdown voltage (up to 20 kilovolts) to its maintaining voltage, which may be of the order of 80 volts. This results in a voltage across the inductance of the connection leads and the diode 35 of, for instance 670 volts. This provides the peak current required into the connection leads and the plug by means of the lead inductance, which may be of the order of 5 μH. The energy stored in the capacitor 26 is thus discharged through the igniter plug.

The apparatus therefore ensures reliable ignition without the need to provide a spark gap. The stress on the thyristor 33 is reduced since it is required only to switch the voltage across the capacitor 28 and to generate the initial high voltage pulse without taking part in the main energy delivery to the plug. Thus, both static and dynamic losses are substantially reduced.

Figure 2:
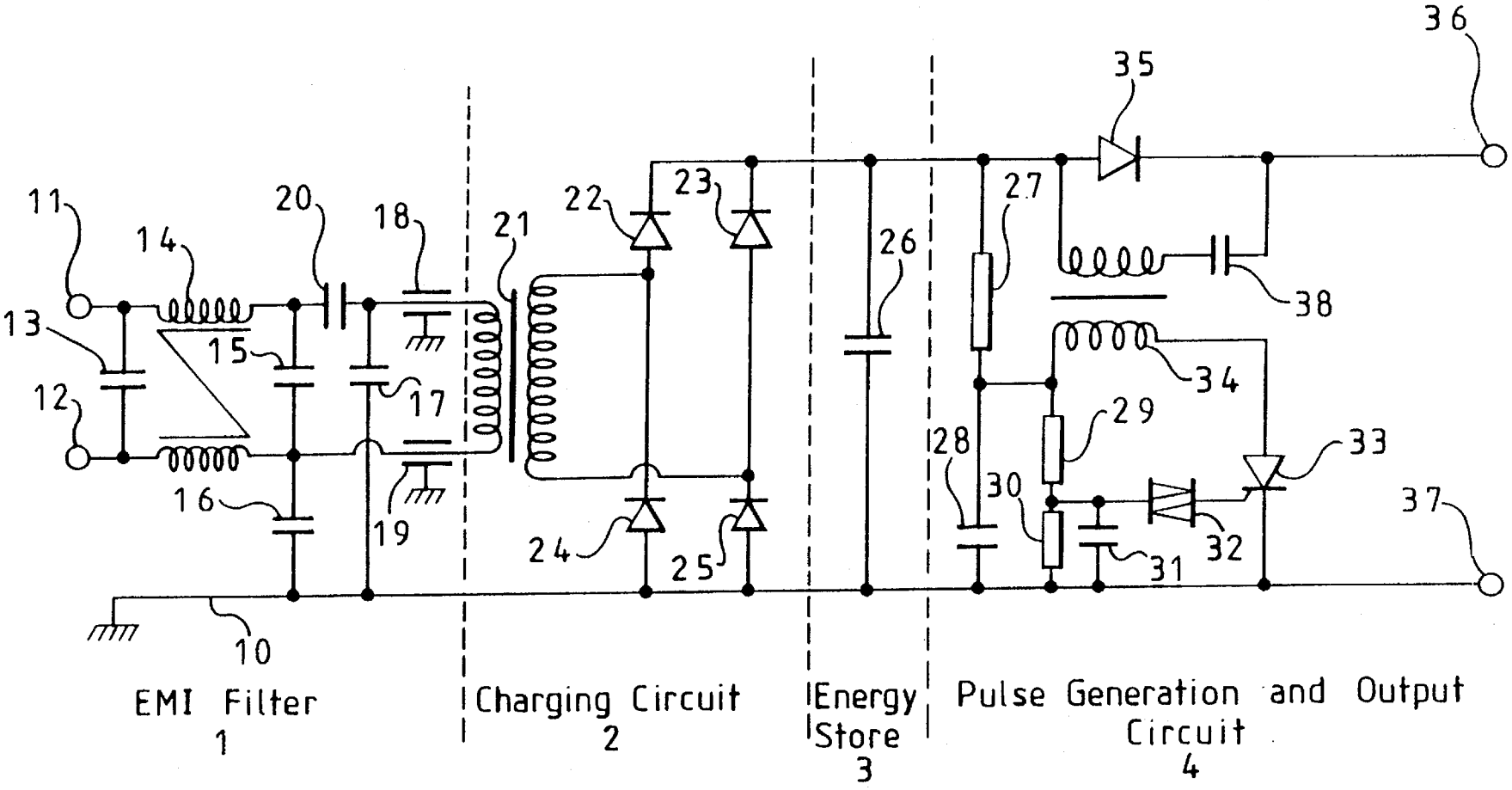
FIG. 2 is a circuit diagram illustrating a modification of the apparatus of FIG. 1.

The apparatus shown in FIG. 2 differs from that shown in FIG. 1 only in that a capacitor 38 is connected in series with the secondary winding of the transformer 34. The capacitor 38 ensures that, once discharge has been initiated in the igniter plug, the secondary winding of the transformer 34 is isolated and the discharge current from the capacitor 26 passes through the diode 35 and not through the secondary winding. Otherwise, the construction and operation of the apparatus shown in FIG. 2 is identical to that shown in FIG. 1 and will not therefore be further described.

I claim:

1. An ignition apparatus, not including any spark gap means, comprising a first energy store, a first charging circuit for charging said first energy store to a first potential difference, a second energy store, a second charging circuit for charging said second energy store to a second potential difference which is less than the first potential difference, a pulse transformer having primary and secondary windings, a discharge device for discharging said second energy store into said primary winding, and output terminals, said secondary winding being connected in series with said first energy store between said output terminals.

2. An apparatus as claimed in claim 1, in which said discharge device comprises a solid state switch.

3. An apparatus as claimed in claim 2, in which said solid state switch comprises a thyristor.

4. An apparatus as claimed in claim 1, in which each of said first and second energy stores comprises a respective capacitor.

5. An apparatus as claimed in claim 1, further comprising a diode connected in parallel with said secondary winding.

6. An apparatus as claimed in claim 5, further comprising a capacitor connected in series with said secondary winding.

7. An apparatus as claimed in claim 1, in which said second charging circuit comprises a potential divider connected across said first energy store.

8. An apparatus as claimed in claim 1, further comprising a trigger circuit for repetitively triggering said discharge device.

* * * * *